US010276964B2

(12) United States Patent
Kropiewnicki et al.

(10) Patent No.: US 10,276,964 B2
(45) Date of Patent: Apr. 30, 2019

(54) CONTACT CARRIER

(71) Applicant: HARTING ELECTRIC GMBH & CO. KG, Espelkamp (DE)

(72) Inventors: Norbert Kropiewnicki, Bielefeld (DE); Xiafu Wang, Dresden (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/745,960

(22) PCT Filed: Aug. 22, 2016

(86) PCT No.: PCT/DE2016/100380
§ 371 (c)(1),
(2) Date: Jan. 18, 2018

(87) PCT Pub. No.: WO2017/036453
PCT Pub. Date: Mar. 9, 2017

(65) Prior Publication Data

US 2018/0219319 A1 Aug. 2, 2018

(30) Foreign Application Priority Data

Aug. 31, 2015 (DE) ..... 10 2015 114 470

(51) Int. Cl.
*H01R 13/42* (2006.01)
*H01R 13/506* (2006.01)
(Continued)

(52) U.S. Cl.
CPC ..... *H01R 13/506* (2013.01); *H01R 4/56* (2013.01); *H01R 13/424* (2013.01); *H01R 13/426* (2013.01); *H01R 13/53* (2013.01)

(58) Field of Classification Search
CPC ..... H01R 13/506; H01R 13/114; H01R 13/4223; H01R 13/193; H01R 13/424;
(Continued)

(56) References Cited

U.S. PATENT DOCUMENTS 4,045,110 A * 8/1977 Sterken ..... H01R 13/436 439/345
4,200,350 A * 4/1980 Zimmerman, Jr. .. H01R 13/424 439/350
(Continued)

FOREIGN PATENT DOCUMENTS

DE 3839014 6/1990 ..... H01R 13/436
DE 102010028802 11/2011 ..... H01R 13/424
(Continued)

OTHER PUBLICATIONS

German Office Action (w/machine translation) issued in application No. 10 2015 114 470.0, dated Jul. 18, 2016 (7 pgs).
(Continued)

*Primary Examiner* — Jean F Duverne
(74) *Attorney, Agent, or Firm* — Hayes Soloway P.C.

(57) ABSTRACT

A contact carrier can be inserted into the contact carrier and removed again by a slight elastic deformation of a holding element, a detent engagement action of a detent of the holding element with a further detent of a main body of the contact carrier can be released. A particularly simple mounting and dismounting of a contact element in the contact carrier is realized. The contact carrier is constructed such that the holding element and the contact element can be inserted into the main body from an attachment side which is situated opposite a plug-in side.

15 Claims, 5 Drawing Sheets

(51) Int. Cl.

| | |
|---|---|
| ***H01R 4/56*** | (2006.01) |
| ***H01R 13/424*** | (2006.01) |
| ***H01R 13/426*** | (2006.01) |
| ***H01R 13/53*** | (2006.01) |

(58) Field of Classification Search
CPC .... H01R 13/436; H01R 13/53; H01R 13/426; H01R 4/56
USPC ..... 439/738
See application file for complete search history.

(56) References Cited

U.S. PATENT DOCUMENTS 4,898,548 A 2/1990 Case et al. ..... 439/686
5,026,304 A * 6/1991 Furrow ..... H01R 13/518 439/595
5,344,347 A * 9/1994 Inoue ..... H01R 13/193 439/701
5,766,836 A * 6/1998 Jones ..... G03C 1/7614 430/527
5,830,010 A * 11/1998 Miskin ..... H01R 9/032 439/578
5,851,128 A * 12/1998 Nakata ..... H01R 13/4223 439/752
8,506,329 B2 * 8/2013 Bonner ..... H01R 13/502 439/274
9,502,786 B2 11/2016 Wang et al. ..... H01R 4/20
9,972,932 B2 * 5/2018 Copper ..... H01R 13/114

FOREIGN PATENT DOCUMENTS

WO WO2013079358 6/2013 ..... H01R 13/426
WO WO2015003692 1/2015 ..... H01R 4/20

OTHER PUBLICATIONS

Harting Industrial Connectors Han®, version 02 8 (version 02 9 unavailable) downloaded on Feb. 8, 2018 at http://www.harting-usa.com/fileadmin/harting/documents/Ig/hartingusa/news/Han_Indusrial_Connectors_v_02_8.pdf (724 pgs).
International Preliminary Report on Patentability (translation) issued in application No. PCT/DE2016/100380, dated Mar. 15, 2018 (8 pgs).
International Search Report (w/translation) and Written Opinion (w/o translation) issued in application No. PCT/DE2016/100380, dated Nov. 15, 2016 (10 pgs).

* cited by examiner

CONTACT CARRIER

BACKGROUND OF THE INVENTION

The invention concerns contact carrier for receiving electrical contact elements.

Contact carriers of this type are required in order to receive electrical contact elements, to install in a plug connector, housing or other electrical device and to electrically shield said electrical contact elements against said plug connector, housing or other electrical device. The electrical contact element is connected to a cable or a lead and is subsequently received in the contact carrier. The contact carrier ensures that the electrical contact element is completely electrically insulated with respect to the device in which said contact element is received.

It is thus possible by means of the contact carrier for the electrical contact to be reliably installed. Accordingly, contact carriers of this type comprise holding devices that render it possible to mechanically fix the contact carrier in a plug connector, housing or other device. It is thus possible for one or multiple contact carriers of this type to be received for example in a plug connector. It is not necessary for the plug connector itself to comprise an electrically insulating housing. Expediently, contact carriers for this purpose are produced from an electrically insulating material, for example a polymer.

Contact carriers that receive only one electrical contact are customary particularly in the field of high current contacts. As a result of the construction size, weight and the associated bulkiness of the contacts, it is possible to provide said contacts individually with a contact carrier and to install said contact in a plug connector, housing or other electrical device.

In order to fix a high current contact of this type in a contact carrier, hitherto usually a two-part contact carrier is used. The base body is usually configured in a cylindrical manner and is provided so as to receive the electrical contact. A closure is provided in order to ensure the electrical contact is securely held in the base body, said closure being placed on one end on an opening of the base body. The closure is screwed on or latched onto the base body depending upon the embodiment of the base body.

The company publication by the company HARTING "Industrie-Steckverbinder Han®, 02 9" (Industrial Connectors Han®, 02 9) discloses cylindrical contact carriers for receiving an electrical contact element. The contact carriers comprise a plug-in end and a connection end. The plug-in end is used for contacting a mating contact, wherein the contact element can be inserted on the connection end into the contact carrier and is held in the contact carrier by means of a holding cap. The contact cap is latched onto the cylindrical base body of the contact carrier, wherein four pairs of latching means are provided on the contact cap and the base body.

This type of contact carriers does in fact comprise a simple assembly procedure in which it is only necessary to insert the contact element into the contact carrier and to snap on the contact cap. However, in contrast, the dismantling procedure of the contact carrier is disadvantageous. It is necessary to simultaneously open multiple latching means before the contact cap can be removed from the base body. Alternatively, a special tool is required in order to remove the contact cap in a simple manner.

There are in fact also embodiments of contact carriers of this type in which the contact cap is held by means of a thread on the base body. However, in this case, the assembly procedure is accordingly more complex since it is likewise necessary to screw the cap on and it is not possible to simply latch the cap on. Moreover, at least one corresponding tool is required for the assembly and dismantling procedures.

The object of the invention is therefore to configure a contact carrier in such a manner that a contact element can be received and fixed, wherein both the assembly procedure as well as the dismantling procedure of the contact element in the contact carrier is to be rendered possible in a simple, rapid manner without auxiliary means such as a tool.

SUMMARY OF THE INVENTION

The invention relates to a contact carrier for receiving an electrical contact element. The contact carrier is formed from a base body and a holding element, wherein the base body can receive an electrical contact element and the holding element is used to fix the contact element in the base body.

The base body is configured as a hollow cylinder and comprises a plug-in end and a connection end. The plug-in end is used for contacting a mating plug connector. The connection end is provided for receiving a contact element. The through-going opening of the hollow cylinder extends from the connection end to the plug-in end through the base body that is configured as a contact receiving arrangement. A plug-in axis extends centrally in the base body along the contact receiving arrangement, said plug-in axis predetermining the plug-in direction—in the direction of the plug-in end—of the contact carrier.

The holding element can be inserted on the connection end of the base body at least in regions into the contact receiving arrangement. Moreover, means for fastening the holding element to the base body are arranged on the connection end. The holding element can thus be fastened to the base body and can fix an electrical contact element that is arranged in the contact receiving arrangement of the contact carrier in said contact carrier.

In order to be able to guide the holding element into the base body, the holding element comprises a guiding region. The guiding region protrudes into the contact receiving arrangement of the base body and guides the holding element along the plug-in axis. The guiding region simultaneously prevents the holding element rotating in the base body. For this purpose, the guiding region is configured in such a manner that said guiding region is guided in guide-ways within the contact arrangement in a linear manner along the plug-in axis.

The guiding region is configured in a specific embodiment as at least one holding arm that is used to hold an electrical contact element in the contact carrier. The holding arm protrudes into the contact receiving arrangement of the contact carrier and holds an inserted electrical contact element in said contact arrangement.

A latching region is molded on to the guiding region of the holding element on the connection end. The latching region is provided so as to fix and hold the holding element in the contact receiving arrangement and on the base body. For this purpose, the latching region of the holding element comprises at least one latching means. The latching means can latch with the base body and thus hold the holding element on the base body and in the contact receiving arrangement.

In an expedient embodiment, further latching means are provided on the base body, said latching means cooperating with the at least one latching means of the holding element. It is possible by means of the latching means and the further latching means to thus transfer a force from the holding element to the base body and it is thus possible to fasten and fix the holding element on the base body.

In a preferred embodiment, it is provided that the latching region and the guiding region of the holding element are not rigidly connected to one another. The latching region and the guiding region are configured in such a manner that they can rotate with respect to one another. The rotation of the regions with respect to one another is oriented about the plug-in axis of the contact carrier.

The two regions are connected to one another via an elastic connection. The elastic connection renders it possible to rotate the region about a limited angle with respect to one another. The guiding region and the latching region automatically orient themselves with respect to one another into the original state by means of the elastic connection.

In a specific embodiment, the holding element is produced from a polymer as a single part in order to render possible an elastic connection and rotation. The latching region and the guiding region are connected via at least one thin connecting piece. The regions are preferably connected to one another via at least three connecting pieces that are deflected and are deformed in an elastic manner when the regions are being rotated with respect to one another.

It is rendered possible by means of the elastic deformation and rotation of the holding element to move the latching means of the holding element out of the engagement region of the further latching means on the base body. The latching means are thus rotated on a circular path to the side out of engagement with the further latching means on the base body when the latching region is being rotated. The latching arrangement and holding arrangement of the holding element in the base body is consequently released.

In order to render it possible to rotate the latching region, the holding element comprises an actuating region in an expedient embodiment, said actuating region being arranged on the latching region. The actuating region is thus arranged outside the contact receiving arrangement and the base body with the result that said actuating region can be operated by means of a user.

Expediently, all the components, but at least the base body and the holding element are produced from an electrically-insulating material, preferably a polymer. The present invention consequently solves the disadvantages that are disclosed in the prior art and achieves the present object.

BRIEF DESCRIPTION OF THE DRAWINGS

An exemplary embodiment of the invention is illustrated in the drawings and is further explained hereinunder.

In the drawings.

DETAILED DESCRIPTION OF THE INVENTION

Figure 1:
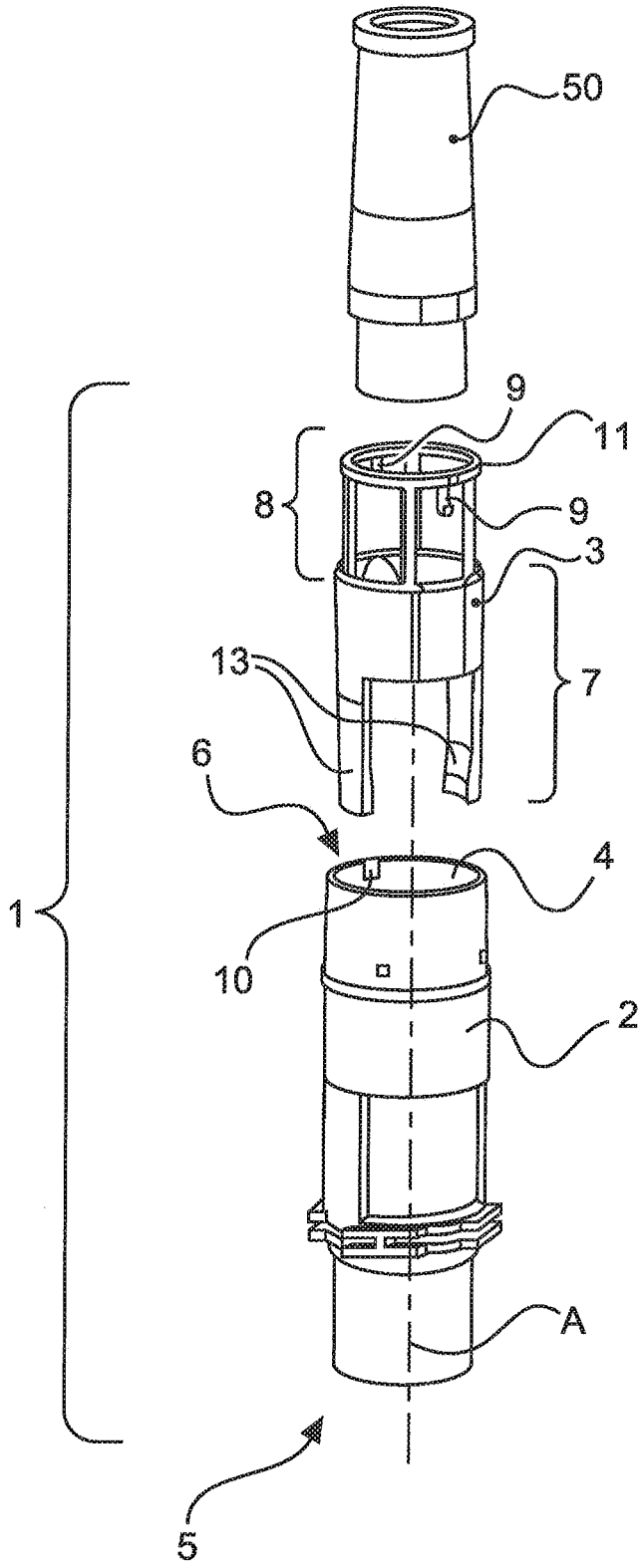
FIG. 1 illustrates an exploded view of a contact carrier having an electrical contact element.

The figures include partially simplified schematic illustrations. In part, identical reference numerals are used for identical but where appropriate non-identical elements. Different views of the same elements could be scaled differently.

FIG. 1 illustrates an exploded view of a contact carrier 1 having an electrical contact element 50. The contact carrier 1 comprises a base body 2 and a holding element 3. The electrical contact element 50 is arranged above said holding element and base body. The parts are arranged along a plug-in axis A that simultaneously defines the assembly axis.

The base body 2 comprises a plug-in end 5 that is provided for contacting a mating plug connector or a mating contact carrier. A connection end 6 of the base body 2 is provided on the rear end of the base body 2 when viewed in the plug-in direction. The connection end 6 and also the plug-in end 5 render it possible to access a through-going opening in the base body 2. The opening forms a contact receiving arrangement 4 that is used to receive the electrical contact element 50.

The contact receiving arrangement 4 is simultaneously provided for receiving the holding element 3. The holding element 3 is formed from a guiding region 7 and a latching region 8. The holding element 3 can be inserted first using the guiding region 7 into the contact receiving arrangement 4. Latching arms 13 are used in the plug-in direction as guiding elements that prevent the holding element 3 rotating in the base body 2. Corresponding moldings are provided in the base body 2, said moldings rendering it possible to guide the latching arms 13.

The connection end latching region 8 of the holding element 3 is formed from multiple connecting pieces 12 that are oriented parallel along the plug-in axis A. An actuating region 11 is formed in the connection end rear region on the connecting pieces 12. The actuating region 11 that is configured as a ring connects the connecting pieces 12 to one another. Moldings are molded on the outer face of said actuating region so as to provide improved haptic feedback.

Moreover, two latching means 9 are molded on the actuating region 11. The latching means 9 are used to secure and fix the holding element 3 in the contact receiving arrangement 4 of the base body 2. For this purpose, the latching means 9 can be latched to further latching means 10 that are located on the inner face of the base body 2 in the contact receiving arrangement 4. The latching means 9 and further latching means 10 are configured in such a manner that they latch to one another when the holding element 3 is being inserted into the contact receiving arrangement 4 and prevent the holding element 3 from being pulled out of the contact receiving arrangement 4.

Figure 2:
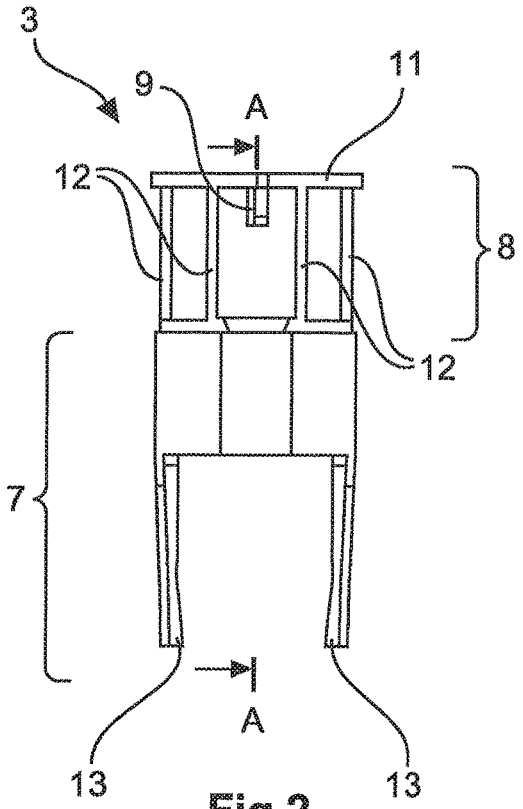
FIG. 2 illustrates a view of an individual holding element.
Figure 3:
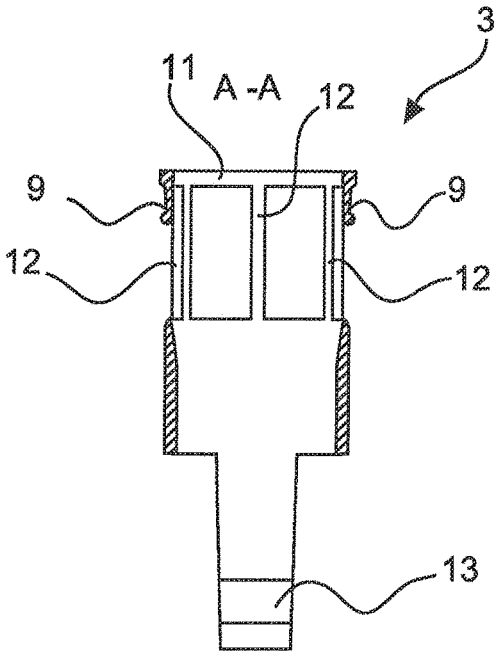
FIG. 3 illustrates a sectional view of a holding element.

The FIGS. 2 and 3 illustrate an individual holding element 3 in a side view or a sectional view. In each case the latching region 8 is evident in the above-illustrated region. The connecting pieces 12 connect the actuating region 11 to the guiding region 7 of the holding element 3.

The guiding region 7 is essentially formed from two latching arms 13. The latching arms 13 are used on the one hand to guide the holding element 3 in the contact receiving arrangement 4. On the other hand, an inserted electrical contact element 50 is held using the latching arms 13. It is possible to subsequently insert a contact element 50 through the holding element 3 into the contact receiving arrangement 4 by means of the latching arms 13 that are oriented slightly inwards. The latching arms 13 are pressed slightly outwards and latch the contact element 50 in the contact receiving arrangement 4.

The two latching means 9 are illustrated on the actuating region 11 and said latching means can be latched to the further latching means 10 on the base body 2. The latching arrangement of the latching means 9 to the further latching means 10 is further illustrated in the FIGS. 5*a*, 5*b* and 5*c*.

Figure 4:
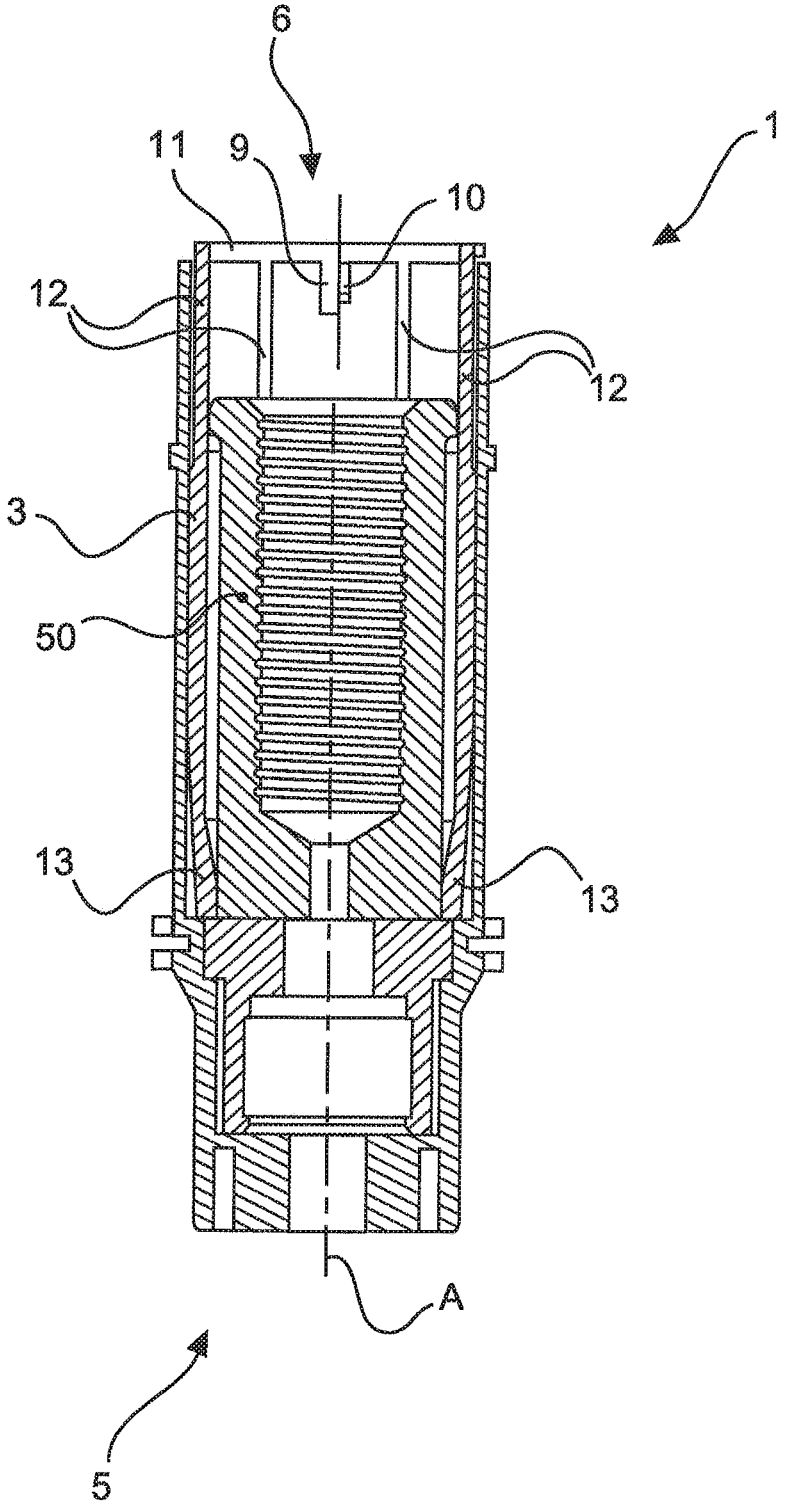
FIG. 4 illustrates a sectional view of a contact carrier having an inserted electrical contact element.

FIG. 4 illustrates a cross section through a contact carrier 1 in accordance with the invention having an inserted electrical contact element 50. The contact element 50 is entirely received in the contact receiving arrangement 4 of the base body 2. Moreover, the holding element 3 is almost entirely received in the contact receiving arrangement 4 above the contact element 50 when viewed in the connection direction. The latching arms 13 hold the contact element 50 securely in the contact receiving arrangement 4. The latching means 9 are latched to the further latching means 10 as a result of which it is not possible to pull the holding element 3 out of the contact receiving arrangement 4.

The actuating region 11 of the latching region 8 of the holding element 3 protrudes from the contact receiving arrangement 4 of the base body 2. It is thus possible for the actuating region 11 to be operated by means of a technician and for the latching region 8 to be rotated. The rotation and unlocking procedure of the latching region 8 is further explained as an operating sequence in the following FIGS. 5*a*, 5*b* and 5*c*.

Figure 5A:
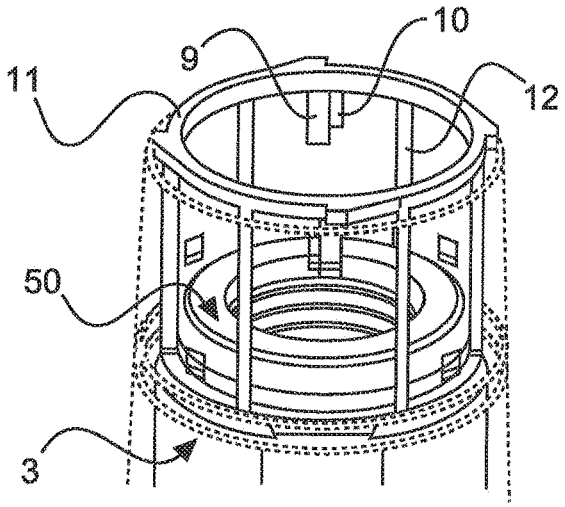
FIG. 5 illustrates an operating principle of a latching region.

The FIG. 5 illustrate the connection end 6 of a contact carrier 1. For the sake of clarity, only the base body 2 is illustrated. It is possible to see in FIG. 5*a* the latching means 9 on the holding element 3 that are latched to the further latching means 10 on the base body 2. It is not possible to pull out and remove the holding element 3.

Figure 5B:
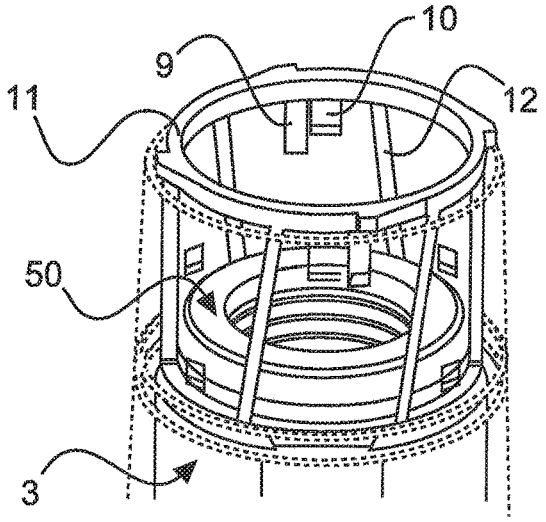

The actuating region 11 of the latching region 8 is illustrated in FIG. 5*b* rotated in the counter-clockwise direction. The connecting pieces 12 are consequently deformed in an elastic manner. The latching means 9 have been rotated out of the engagement region of the further latching means 10. As a consequence, the latching means 9, 10 are no longer latched to one another.

Figure 5C:
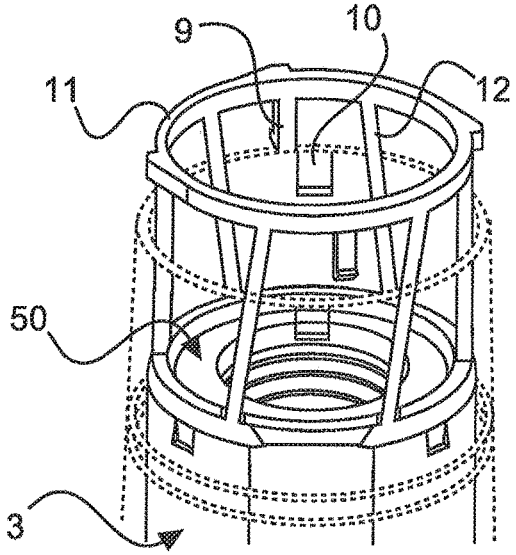

The holding element 3—as is illustrated in FIG. 5*c*—can be pulled out of the contact receiving arrangement 4. A blockage by means of the latching means 9 and further latching means 10 no longer prevents this. This advantageous embodiment achieves the object in accordance with the invention as a result of which it is rendered possible to assemble and dismantle a contact element 50 in a contact carrier 1 without the need of a tool. The contact element 50 can be rapidly inserted and removed again by means of a small rotation on the actuating region 11 without a large outlay of time or application of force. Nevertheless, a secure fit of the contact element 50 in the contact carrier 1 is achieved.

Figure 6A:
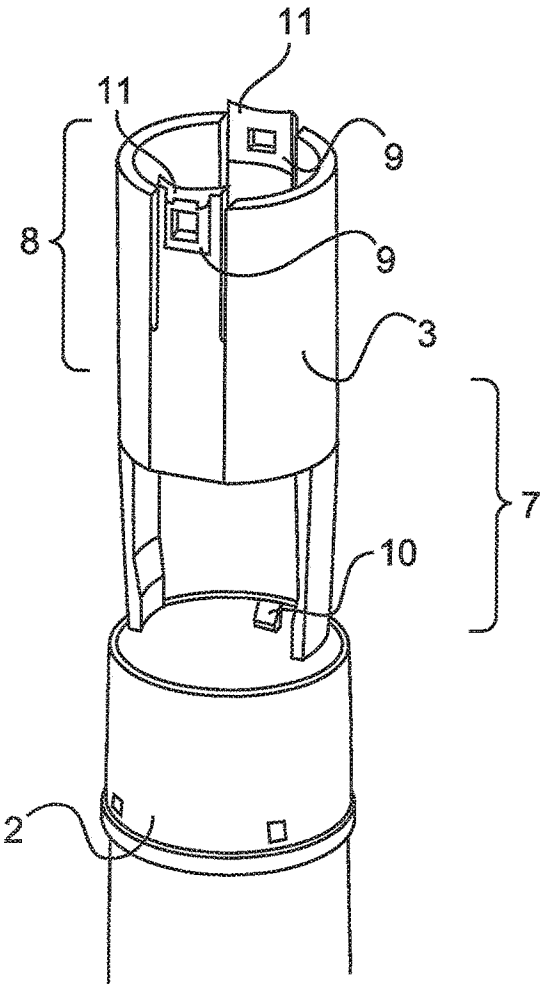
FIG. 6 illustrates a further exemplary embodiment.
Figure 6B:
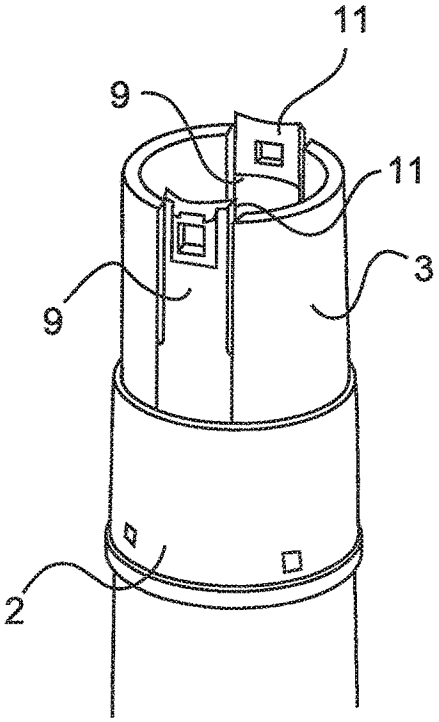
Figure 6C:
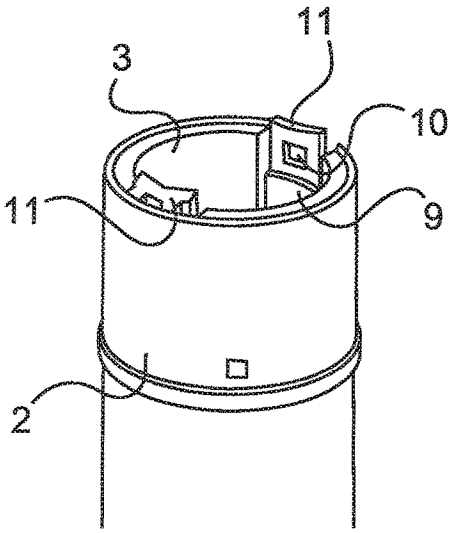

The FIGS. 6*a*, 6*b* and 6*c* illustrate a further exemplary embodiment of the subject matter in accordance with the invention. In contrast to the first illustrated embodiment, the latching means 9 is configured as a resilient arm. The resilient arm extends in the axis direction towards the connection end 6 of the contact carrier 1.

The FIG. 6*a* illustrates two latching means 9 in the latching region 8 of the holding element 3. The latching means 9 are arranged on opposite-lying sides in the latching region 8. The latching means 9 are formed in a mechanically flexible manner on the holding element 3 as a resilient arm. The free ends of the latching means 9 that are illustrated in the upper region of the figure are flexible and can be moved inwards towards the plug-in axis A. Recesses are provided in the region of the free ends of the latching means 9, said recesses being provided for latching to the further latching means 10.

The further latching means 10 are arranged on the inner face of the base body 2. When the holding element 3 is being inserted into the base body 2, the latching means 9 can be deflected radial inwards with the result that the further latching means 10 can engage into the recesses of the latching means 9. The holding element 3 is thus fixed in the base body 2.

In order to dismantle the holding element 3, it is only necessary for the latching means 9 to be moved inwards towards the plug-in axis A. The latching arrangement of the latching means 9 to the further latching means 10 is thus released and it is possible to dismantle the holding element 3 from the base body 2.

The invention claimed is:

1. A contact carrier for receiving an electrical contact element, wherein the contact carrier comprises a base body and a holding element;

wherein the base body comprises a plug-in end and a connection end, and a through-going opening that is configured as a contact receiving arrangement;

wherein the contact receiving arrangement extends from the connection end to the plug-in end along a plug-in axis through the base body;

wherein the holding element is adapted to be fastened to the connection end of the base body;

wherein the holding element comprises a guiding region that protrudes into the contact receiving arrangement, and also comprises a latching region;

wherein the latching region comprises at least one latch, adapted to be latched to the base body; and wherein the latching region and the guiding region are configured as a single part and are connected to one another via at least two elastically deformable connecting pieces in such a manner that they can rotate with respect to one another, wherein the electrical contact element can be fixed in and dismantled from the contact carrier without a tool, by rotating the latching region, whereupon the contact element can be pulled out of the contact carrier.

2. The contact carrier as claimed in claim 1, wherein the guiding region is adapted to be guided along the plug-in axis in the contact receiving arrangement in a manner that can be secured so as to prevent rotation.

3. The contact carrier as claimed in claim 1, wherein the latch is adapted to be latched to a further latch on the base body.

4. The contact carrier as claimed in claim 1, wherein the holding element is adapted to be blocked by the latch against a linear movement that is oriented in the direction of the connection end.

5. The contact carrier as claimed in claim 1, wherein the latching region and the guiding region are configured to rotate with respect to one another about the plug-in axis.

6. The contact carrier as claimed in claim 1, wherein the latching element is arranged on the holding element in such a manner that said latching element can move.

7. The contact carrier as claimed in claim 6, wherein the latching element is configured as a resilient arm, wherein the resilient arm protrudes towards the connection end.

8. The contact carrier as claimed in claim 1, wherein the latching element is adapted to be deflected radially inwards towards the plug-in axis.

9. The contact carrier as claimed in claim 1, wherein the latching region is adapted to assure a first, latching position and a second, released position.

10. The contact carrier as claimed in claim 9, wherein the latch is latched to the base body in the first, latching position of the latching region.

11. The contact carrier as claimed in claim 9, wherein the latch is not latched to the base body in the second, released position of the latching region.

12. The contact carrier as claimed in claim 1, wherein the latching region is arranged at least in regions outside the contact receiving arrangement and forms an actuating region at that location.

13. The contact carrier as claimed in claim 1, wherein the holding element comprises at least one holding arm that protrudes into the contact receiving arrangement.

14. The contact carrier as claimed in claim 1, wherein the base body is formed from an electrically insulating material.

15. The contact carrier as claimed in claim 1, wherein the holding element is formed from an electrically insulating material.

* * * * *